United States Patent [19]

Lauckhardt

[11] Patent Number: 4,465,216

[45] Date of Patent: Aug. 14, 1984

[54] THERMOPLASTIC ROD ADVANCE MECHANISM

[75] Inventor: Gerhard Lauckhardt, Frankfurt am Main, Fed. Rep. of Germany

[73] Assignee: USM Corporation, Farmington, Conn.

[21] Appl. No.: 425,945

[22] Filed: Sep. 28, 1982

[30] Foreign Application Priority Data

Sep. 29, 1981 [DE] Fed. Rep. of Germany ... 8128501[U]

[51] Int. Cl.[3] ..... B65H 51/18

[52] U.S. Cl. ..... 226/158; 226/108; 226/167

[58] Field of Search ..... 226/158, 167, 196, 151, 226/128, 200, 198, 89, 159, 160, 161, 162, 163, 164, 165, 166, 115, 108, 120; 254/228, 252, 254, 257, 259

[56] References Cited

U.S. PATENT DOCUMENTS

| | | | |
|---|---|---|---|
| 311,785 | 2/1885 | Reynolds | 226/167 |
| 3,061,163 | 10/1962 | Black | 226/167 |
| 3,066,841 | 12/1962 | Hancock | 226/167 X |
| 3,292,835 | 12/1966 | Wolf | 226/167 X |
| 3,575,330 | 4/1971 | Sniderman | 226/167 X |
| 3,854,647 | 12/1974 | Mittendorf | 226/167 X |

*Primary Examiner*—Stuart S. Levy
*Assistant Examiner*—Leo Peters
*Attorney, Agent, or Firm*—Donald N. Halgren

[57] ABSTRACT

In a rod cement feeding apparatus, the rod passes between two plates, pivoted to one another, each plate having a semi-cylindrical groove, so that the two grooves for a substantially cylindrical passageway for the rod. The surfaces of the plates in which the grooves are provided are, over most of their length, spaced apart by projections, so that opposed slots are formed which extend into the passageway for the rod. Projecting into one such slot is a spring-urged jaw which co-operates with a fixed jaw which projects into the other slot, the jaws being moved lengthwise of the passageway by a pneumatic cylinder arrangement. As the jaws are moved in one direction, the spring-urged jaw tends to bite into the rod so that the rod is fed with the jaws during their advancing movement, while when the jaws are moved in the opposite direction the rotatable jaw releases its grip so that there is no tendency for the rod to be fed in the opposite direction. In the event of a jam in the passageway or slot(s), which thus prevents the rod from being fed, it is merely necessary to unclamp the plates and pivot them apart to gain access to the passageway for cleaning purposes.

4 Claims, 3 Drawing Figures

THERMOPLASTIC ROD ADVANCE MECHANISM

BACKGROUND OF THE INVENTION (1) Field of the Invention

The invention is concerned with a device for advancing a rigid rod of thermoplastic adhesive comprising a guide which receives the rod and is provided with opposed slits through which jaws for pressing against the rod project, which jaws are mounted for movement along the guide and, during their advancing movement, move the rod therewith.

(2) Prior Art

Such devices are known in connection with machines currently in use in the manufacture of shoes, in which machines the cement rod is advanced to a melt chamber from which the molten adhesive is then supplied to the operating station.

In such devices the situation arises again and again that the adhesive rod is arrested after it has left the advancing device and especially before it reaches the melt chamber, so that the advancing of the rod under the action of the jaws leads to a wedging of the rod, which thus is pressed especially into the slit. The device is thus so completely choked up with the adhesive material that further advancing of the adhesive rod is rendered impossible. In order to render the device operative again, the obstruction must be cleared, which is difficult, having regard to its length and the slit. The adhesive must thus be bored out of the guide in a regular manner and be scratched out of the slit. The consequence of this is an extended interruption of work, which is especially disadvantageous where it is necessary for the shoe manufacturing machines to operate continuously.

The object of the present invention resides in improving the ability to clean the device described in the introduction.

BRIEF SUMMARY OF THE INVENTION

In accordance with the invention this arises in that the guide consists of two separable plates which are provided each with opposed grooves which receive the rod when the plates are brought together and are held together by a releaseable clamping device, the walls of the slits being formed by the surfaces of the plates in such a manner that, when the plates are separated from one another, the guide formed by the slots and the slits are opened.

This construction results in the plates, when separated from one another, exposing their inner surfaces for cleaning purposes and the adhesive being able to be readily removed when the plates are separated. Wedging in the slit can in no way any longer arise, since the slit is opened and thereby the adhesive can be removed from the slit wall in question without more ado.

Preferably the grooves are arranged symmetrically with one another, since in this case the fabrication of the plates is facilitated and equally good cleaning conditions arise for both plates.

Conveniently the two plates can be connected with one another for pivotal movement by a hinge. In this case the one can be swung from the other for separating the plates.

Conveniently a threaded member can be used for the clamping device, by means of which in a simple way the two plates can be held together.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
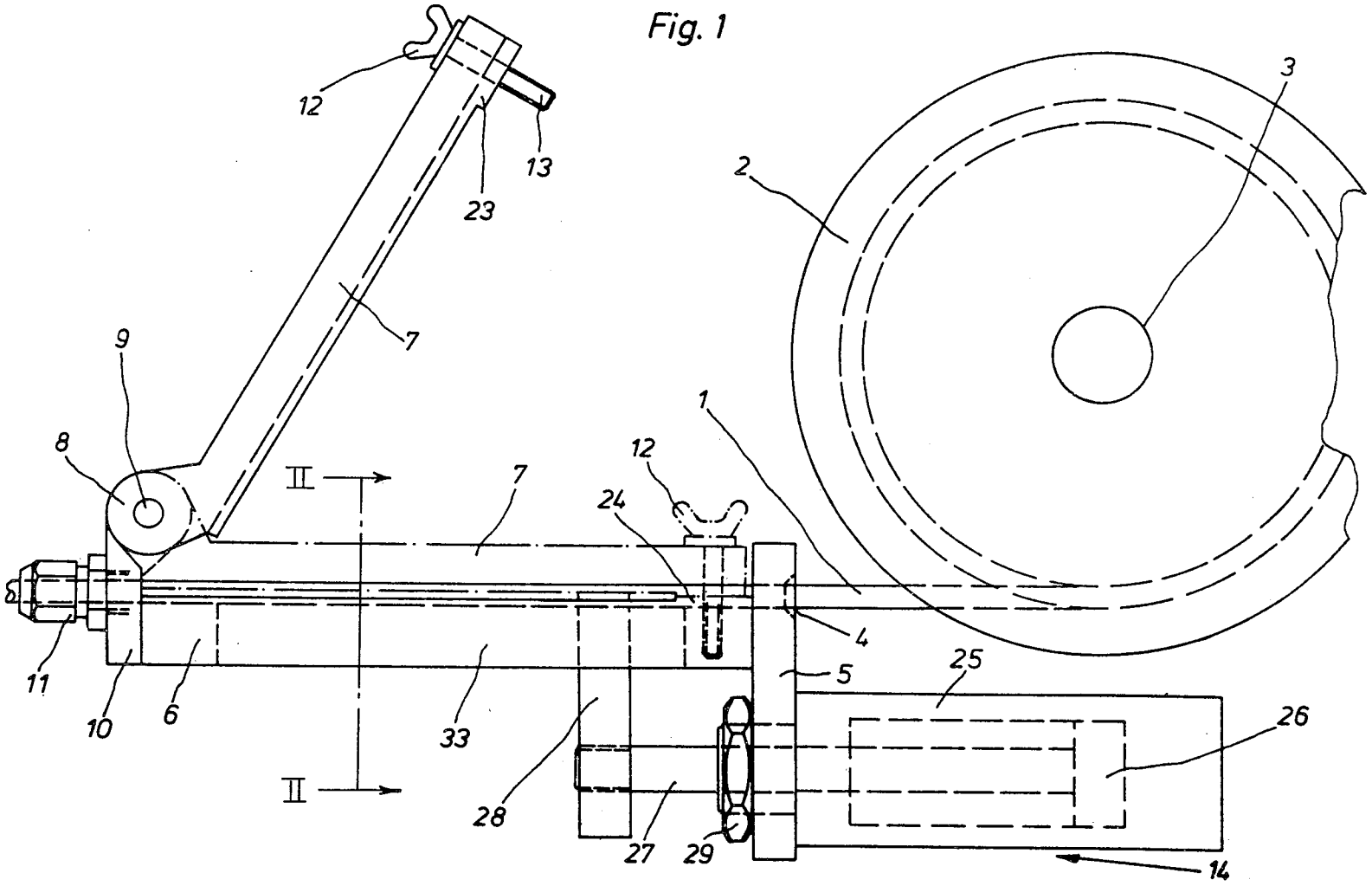
FIG. 1 shows the device in side view.

In the device shown in FIG. 1 the adhesive rod 1 is drawn from a supply roll 2, which is journalled on the axis 3 for easy rotational movement. The adhesive rod 1 is drawn through the inlet opening 4 on the holder arm 5 into the device. On the holder arm 5 is secured at right angles the plate 6 opposite which, in the normal position, the plate 7 is shown in chain dot line is arranged. The plate 7 is also shown in FIG. 1 in full line in its swung-open position. The plate 7 is for this purpose connected with the plate 6 for pivotal movement, via the hinge 8 with the axis 9. Furthermore on the plate 6 is secured the end piece 10 into which the threaded member 11 is inserted on which an extension sleeve is secured. On the side of the plate 7 opposite the hinge 8 is inserted the wing screw 12 which, when the plates 6 and 7 are brought together, projects with its threaded portion 13 into the plate 6 and is there screwed with the latter, so that the two plates 6 and 7 in this condition form a fixed unit.

Before more detail is set out of the feed mechanism 14 for advancing the adhesive rod 1, first the inner construction of the two plates 6 and 7 is to be described with reference to FIG. 2, which shows a section along the line II—II of FIG. 1. The two plates 6 and 7 are adapted for guiding the adhesive rods 1 and 1' (the device is to this end provided with two adjacent supply rolls 2) and has for this purpose the substantially semicircular grooves 15, 16 and 17, 18. Thus the pair of grooves 15, 16 receives the rod 1' and the pair 17, 18 the rod 1.

Figure 2:
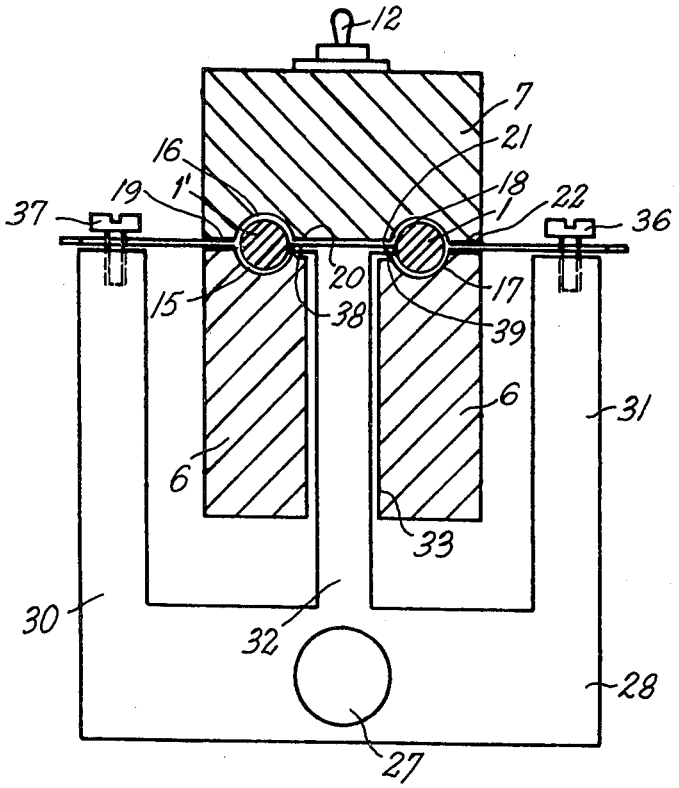
FIG. 2 shows the same device in cross section along the line II—II of FIG. 1.

With the two plates 6 and 7 in the brought-together position shown in FIG. 2, the inner surfaces thereof leave free the slits 19, 20 and 21, 22, the walls of these slits being formed by the inner surfaces of the plates 6 and 7. The width of the slits 19, 20 and 21, 22 is determined by the two plates 6 and 7 having at their ends, when in the brought-together position shown in FIG. 2, a defined position, namely achieved on the one side by the hinge 8 shown in FIG. 1 and on the other side by the projections 23 and 24 which can also be seen in FIG. 1. The projection 23 on the plate 7 has the same height as the projection 24 on the plate 6 so that, in the brought-together position of the two plates 6 and 7 there is a uniform distribution of half the slit width between the plates 6 and 7. The slits 19, 20 and 21, 22 therefore extend symmetrically into the guides provided by the grooves 15, 16 and 17, 18.

The advancing of the rods 1 and 1' is effected as follows: the advancing mechanism 14 contains a pneumatic cylinder 25 and the piston 26 which is moved to and fro therein by air pressure in known manner, the piston being threadedly connected by its piston rod 27 with the bifurcated advancing member 28. The cylinder 25 is secured by the threaded member 29 on the holder arm 5.

Figure 3:
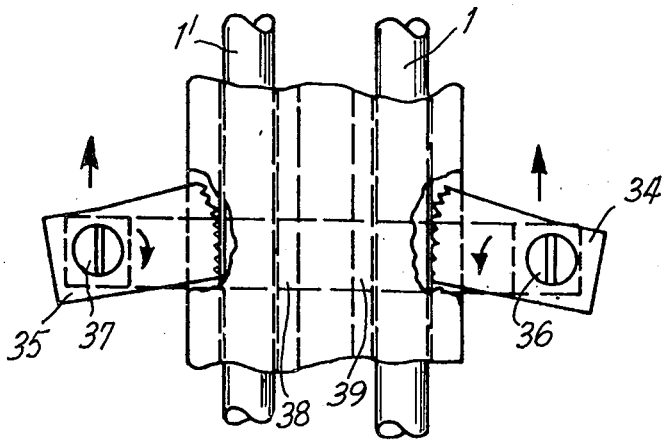
FIG. 3 shows a fragment of the device shown in FIGS. 1 and 2, illustrating the jaws.

The configuration of the bifurcated member 28 is clearly to be seen in FIG. 2. Said member 28 embraces the two plates 6 and 7 with its two prongs 30 and 31 and projects through the plate 6 with a further prong 32. The plate 6 is for this purpose provided with a longitudinal slot 33. On the end of the two prongs 30 and 31 are mounted the two rotatable jaws 34 and 35 shown in FIG. 3, which jaws are held by the screws 36 and 37. The rotatable jaws 34 and 35 are subject to rotational spring loading, by springs (not shown), in the direction of the arrows shown within the jaws 34 and 35, so that the jaws have the tendency to be urged against the rods 1 and 1'. In order to utilize this pressure, there are provided at the end of the prong 32 the two fixed jaws 38 and 39 which extend outwardly at right angles on the end of the prong 32 and project through the slits 20 and 21. In the same way the rotatable jaws 34 and 35 project through the slits 19 and 22, so that when the jaws 34, 39 and 35, 38 are adjacent one another the rods 1 and 1' are not pressed against the walls of the grooves 15, 16 and 17, 18. Therefore when said jaws are advanced in practice no friction arises between the grooves 15, 16 and 17, 18 on the one hand and the rods 1 and 1' on the other. For advancing the rods 1 and 1' the piston 26 (see FIG. 1) is advanced by compressed air from the position shown to the opposite position, the bifuricated member and thus the jaws 34, 39 and 35, 38 moving therewith, and the jaws for their part moving the corresponding rod 1 or 1' therewith. On the return movement of the piston 26 into its initial position shown in FIG. 1, the jaws 34 and 35 can, because of their inclined condition as seen in FIG. 3 and the rotational spring loading provided, be released from the rods 1 and 1', so that, during the return movement of the piston 26, the rods 1 and 1' are not moved therewith into the initial position shown in FIG. 1. The direction of advance of the rods 1 and 1' is indicated by the arrows drawn in FIG. 3 above the jaws 34 and 35.

Should a build up now arise behind the threaded member 11 because of any obstruction of a rod 1 or 1', and a rod 1 or 1' become jammed within the device under the action of the advancing mechanism 14, so that it wedges in the corresponding grooves 15, 16 or 17, 18 and the associated slits 19, 20, or 21, 22, the cleaning of the device which is then required can be carried out very easily, since for this purpose the plate 7 is merely brought to its swung-open condition shown in FIG. 1, so that the inner surfaces of the plates 6 and 7 and the said grooves and slits are freely accessible. As a consequence the adhesive which has previously been wedged in the device drops now without more ado.

I claim:

1. A common mechanism for simultaneously advancing a pair of rigid rods of thermoplastic adhesive comprising a guide which receives the rods and is provided with opposed slits, a jaw projecting through each slit for pressing against the rods, said jaws being mounted for movement along the guide and, during their advancing movement, moving the rods therewith, wherein the guide consists of a pair of separable plates (6, 7) which are provided each with opposed grooves (15, 16; 17, 18) which receive the rods, 1'(1), when the plates (6,7) are brought together a releaseable clamping device for holding the plates together (12, 13), the walls of the slits (19, 20; 21, 22) being formed by the inside surfaces of the plates (6,7) in such a manner that, when the plates (6, 7) are separated from one another, the guide formed by the grooves (15, 16; 17, 18) and the slits (19, 20; 21, 22) are opened.

2. A common mechanism for advancing a pair of rigid rods of adhesive as recited in claim 1 wherein the grooves (15, 16; 17, 18) are arranged symmetrically with one another.

3. A common mechanism for advancing a pair of rigid rods of adhesive as recited in claim 2 wherein both plates (6, 7) are connected by a hinge (8, 9) for pivotal movement relative to one another.

4. A common mechanism for advancing a pair of rigid rods of adhesive as recited in claim 3 wherein the clamping device consists of a threaded member (12, 13).

* * * * *